US005213065A

United States Patent [19]

Wilson et al.

[11] Patent Number: 5,213,065

[45] Date of Patent: May 25, 1993

[54] STEAM GENERATOR FEEDWATER DISTRIBUTION SYSTEM

[75] Inventors: Robert M. Wilson, Plum Boro, Pa.; King W. Chan, Lutz; Daniel E. Ford, Cantonment, both of Fla.

[73] Assignee: Westinghouse Electric Corp., Pittsburgh, Pa.

[21] Appl. No.: 749,363

[22] Filed: Aug. 23, 1991

[51] Int. Cl.[5] ..... F22B 1/06

[52] U.S. Cl. ..... 122/34; 122/407; 122/438; 122/488

[58] Field of Search ..... 122/34, 32, 407, 438, 122/488

[56] References Cited

U.S. PATENT DOCUMENTS

| | | | |
|---|---|---|---|
| 3,916,841 | 11/1975 | Schröder et al. . | |
| 3,923,007 | 12/1975 | Schroder | 122/407 |
| 3,942,481 | 3/1976 | Bennett . | |
| 3,991,720 | 11/1976 | Byerley . | |
| 4,198,929 | 4/1980 | Forestier et al. . | |
| 4,204,502 | 5/1980 | Forestier et al. . | |
| 4,205,632 | 6/1980 | Tratz | 122/34 |
| 4,208,987 | 6/1980 | Chaix et al. | 122/34 |
| 4,357,908 | 11/1982 | Yazidjian . | |
| 4,357,909 | 11/1982 | Kagoshima . | |
| 4,498,426 | 2/1985 | Leroy et al. . | |
| 4,502,419 | 3/1985 | Smith, Jr. . | |
| 4,554,889 | 11/1985 | Lilly . | |
| 4,579,088 | 4/1986 | Kim, Jr. et al. . | |
| 4,736,713 | 4/1988 | Roarty . | |

*Primary Examiner*—Henry C. Yuen
*Attorney, Agent, or Firm*—A. C. Addessi

[57] ABSTRACT

A steam generator comprises a distribution means, positioned between the shell and the wrapper in the annular downcomer region of the steam generator, for uniformly mixing the colder feedwater with the warmer recirculating water in the downcomer region of the steam generator so that the colder feedwater is not introduced directly into any steam regions of the steam generator and does not contact any pressure boundaries for preventing water hammer and thermal shock to the steam generator. The distribution means has a downwardly directing means for discharging the substantially evenly distributed feedwater from the distribution means into the downcomer region in a descending direction and away from any pressure boundaries for minimizing flow resistance and for preventing thermal shock to the pressure boundaries. The feedwater and the recirculating water are substantially uniformly mixed in the mixing zone of the downcomer region of the steam generator prior to the mixture of feedwater and recirculating water entering the tube bundle or contacting any pressure boundaries, thereby preventing thermal shock and water hammer to the steam generator.

26 Claims, 3 Drawing Sheets

STEAM GENERATOR FEEDWATER DISTRIBUTION SYSTEM

BACKGROUND

1. Field of the Invention

This invention relates to steam generators for nuclear power plants and more particularly to steam generators having a feedwater distribution device disposed in the annular downcomer region of the steam generator.

2. Description of the Prior Art

A steam generator of conventional type includes a tube bundle positioned within a shell and encircled by a wrapper. An annular downcomer region is formed between the shell and the wrapper. In certain steam generators, feedwater is introduced into a feedwater inlet device positioned at an elevation above the tube bundle. Feedwater is introduced into the shell through an inlet nozzle, travels down the annular downcomer region, and up through the tube bundle where the feedwater is heated by primary fluid passing through the tubes of the tube bundle.

The introduction of cold feedwater into a steam region of the steam generator can create a water hammer event due to the possibility of the cold feedwater quenching saturated temperature steam present in the steam generator. The steam can instantaneously collapse, thereby producing shock waves and component loadings in the steam generator. Smaller scale bubble collapse phenomena can complicate controlling the water level in the steam generator. The introduction of cold feedwater directly into the tube bundle where steam may be present can present operational concerns. Also, contact of the cold feedwater with hotter pressure boundary components, such as the tubesheet or the shell, may produce undesirable thermal fatigue.

Currently, to limit the potential of water hammer or thermal shock to the steam generator, complex and expensive feedwater temperature and flow path monitoring and control equipment is used.

As disclosed in U.S. Pat. No. 4,357,908 issued Nov. 9, 1982 to Jean-Claude Yazidjian entitled "Steam Generator with Pre-heating," the cold feedwater can be mixed with the warmer recirculating water in a space within a double-walled wrapper. The inner wrapper, or secondary envelope, encircles the tube bundle and the outer wrapper, or skirt, providing a thermal barrier to the shell. However, this double-walled wrapper within the space between the secondary envelope and the outer wall of the vessel adds additional cost to the steam generator. Also, the feedwater inlet ring is positioned at an elevation above the tube bundle at an upper portion of the steam generator for mixing the feedwater and recirculating water at the top region of the annular downcomer.

Therefore, what is needed is a steam generator having a feedwater distribution means for uniformly mixing the cold feedwater, which can be introduced into the steam generator at any elevation within the downcomer region, with the warmer recirculating water in the downcomer region of the steam generator prior to entry of the mixture into the tube bundle for reducing the possibility of water hammer and thermal shock to the steam generator without the additional cost of unnecessary components.

SUMMARY OF THE INVENTION

A steam generator comprises a distribution means for uniformly mixing the colder feedwater with the warmer recirculating water in the downcomer region of the steam generator so that the colder feedwater is not introduced directly into any steam regions of the steam generator and does not contact any pressure boundaries for preventing water hammer and thermal shock to the steam generator.

The distribution means, such as a distribution device, is positioned between the shell and the wrapper in the annular downcomer region of the steam generator for receiving the feedwater from the inlet nozzle and for distributing the feedwater substantially uniformly throughout at least a portion of the annular downcomer region.

The distribution device discharges the feedwater from an upper portion of the distribution device and directs the feedwater by a downwardly directing means, such as a J-tube assembly having a plurality of J-shaped tubes and a plurality of mixing tubes. An alternative embodiment of the downwardly directing means may be a turning-weir. The downwardly directing means discharges the feedwater from the distribution means in a descending direction for minimizing flow resistance of the feedwater and the descending recirculating water. The downwardly directing means also directs the flow of feedwater away from any pressure boundaries for preventing thermal shock to the steam generator.

The feedwater and the recirculating water are substantially mixed in the mixing zone of the downcomer region of the steam generator prior to the mixture of feedwater and recirculating water entering the tube bundle or before coming into contact with the pressure boundary, thereby preventing thermal shock and water hammer to the steam generator.

A method for uniformly mixing the feedwater with the recirculating water in the annular downcomer region of the steam generator comprises the steps of directing the flow of the feedwater circumferentially in both directions around at least a portion of the annular downcomer region, directing the flow of the feedwater toward a downwardly directing means of the distribution device, discharging the feedwater from the downwardly directing means into the annular downcomer region and mixing the feedwater with the descending recirculating water in the downcomer region of the steam generator.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides a steam generator having a feedwater distribution system comprising a distribution means for uniformly mixing the colder feedwater with the warmer recirculating water in the downcomer region of the steam generator so that the colder feedwater is not introduced directly into any steam regions of the steam generator and does not contact any hotter pressure boundaries for preventing water hammer and thermal shock to the steam generator.

Figure 1:
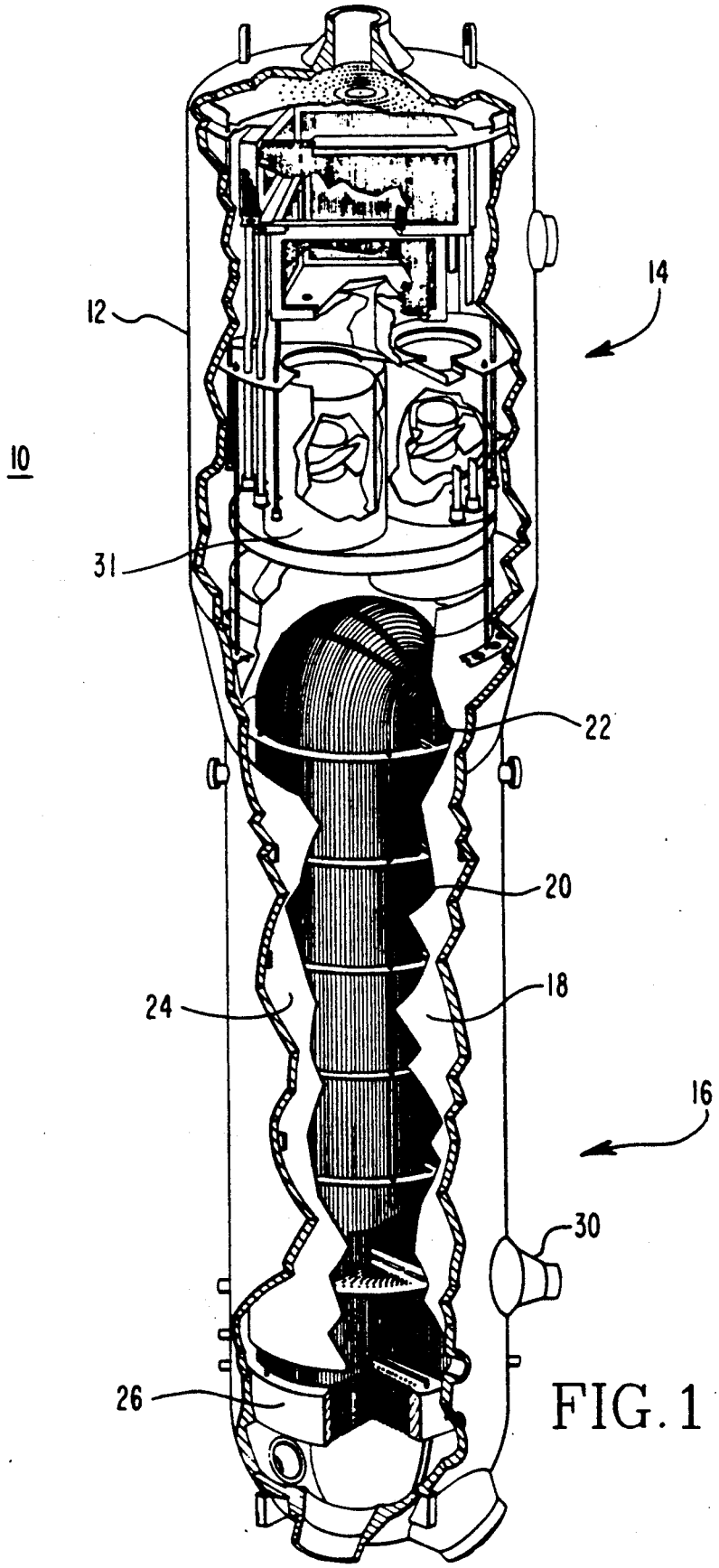
FIG. 1 is a perspective view of a steam generator.

Referring to FIG. 1, a steam generator 10 is shown comprising a generally cylindrical shell 12 having an upper portion 14 and a lower portion 16. Disposed in the upper portion 14 is a moisture separating means for separating a steam-water mixture. Disposed in the lower portion 16 is a wrapper 18, which encircles a tube bundle 20. The tube bundle 20 has a plurality of vertical U-shaped steam generator tubes 22. An annular downcomer region 24 is formed in the space between the wrapper 18 and the shell 12. Disposed in the lower portion 16 and attached to the shell 12 is a tubesheet 26 having a plurality of apertures therethrough for receiving an end of each tube 22. Feedwater enters the steam generator 10 through an inlet nozzle 30, which may be positioned at any elevation between the tubesheet 26 and the upper portion 14 of the steam generator 10, and mixes with recirculating water in the annular downcomer 24. The mixture of feedwater and recirculating water is commonly referred to as secondary fluid.

Primary fluid enters the steam generator below the tubesheet 26 through a nozzle, flows through the tubes 22, and exits below the tubesheet 26 through another nozzle. In a typical pressurized water reactor steam generator, the primary fluid may obtain a temperature of approximately 620° F. and a pressure of approximately 2250 pounds per square inch absolute (psia) and the secondary fluid may obtain a temperature of approximately 540° F. and a pressure of approximately 1000 psia. Due to the heat transfer from the primary fluid to the secondary fluid through the walls of the tubes 22, a portion of the secondary fluid vaporizes into a steam-water mixture. The steam-water mixture flows upwardly from the tube bundle 20 and is separated by the moisture separating means 31 into saturated water and dry saturated steam. The dry saturated steam exits the steam generator through a steam outlet nozzle positioned in the upper portion 14 of the steam generator 10 and the saturated water recirculates within the steam generator 10.

For the various embodiments of this invention, the same reference characters will be used to designate like parts. In addition, like functions and like interactions of the parts among the various embodiments of this invention will not be repeated for each embodiment.

Figure 4:
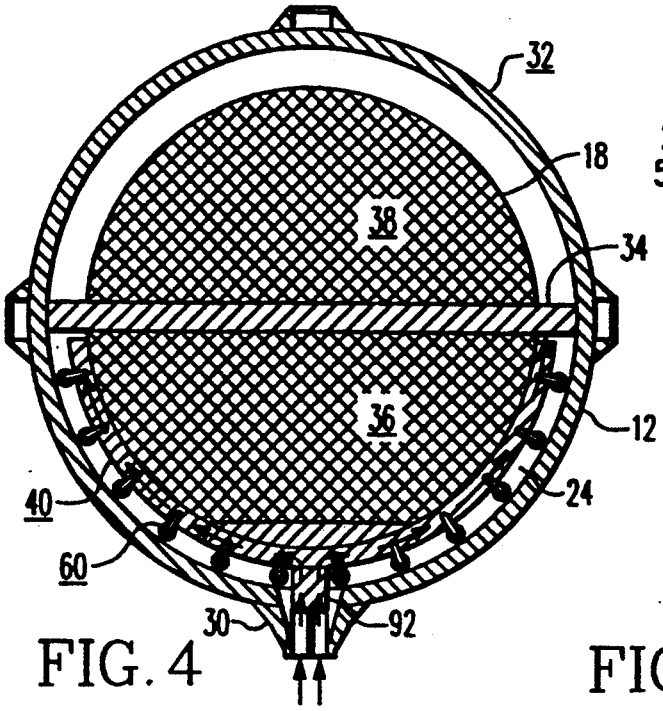
FIG. 4 is a cross-sectional view of a steam generator with a cold leg side having the distribution means of FIG. 2 encircling a portion of the tube bundle.
Figure 8:
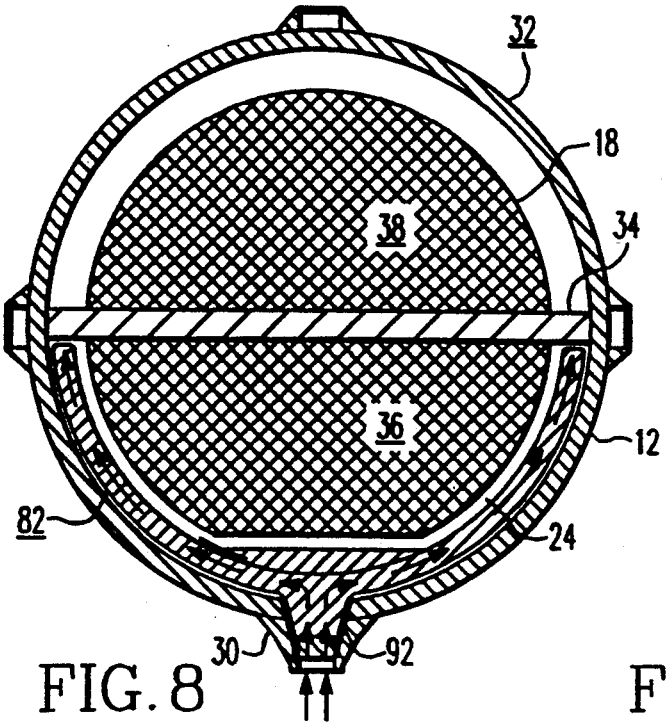
FIG. 8 is a cross-sectional view of the steam generator with a cold leg side having the distribution means of FIG. 5 encircling a portion of the tube bundle.

Referring to FIG. 4 and FIG. 8 and using the same reference characters to define like parts, an alternative embodiment of the steam generator 10 may be a steam generator 32 having like parts as the steam generator 10 and additionally having a partition plate 34 separating a cold leg side 36 having a preheater (not shown) and a hot leg side 38. Feedwater enters the steam generator 32 through the inlet nozzle 30 into the cold leg side 36 of the steam generator 32. The primary fluid enters the steam generator 32 below the tubesheet through a nozzle (not shown) into the hot leg side 38 of the steam generator 32, flows through the tubes, and exits below the tubesheet through a nozzle (not shown) positioned on the cold leg side 36 of the steam generator 32.

Figure 2:
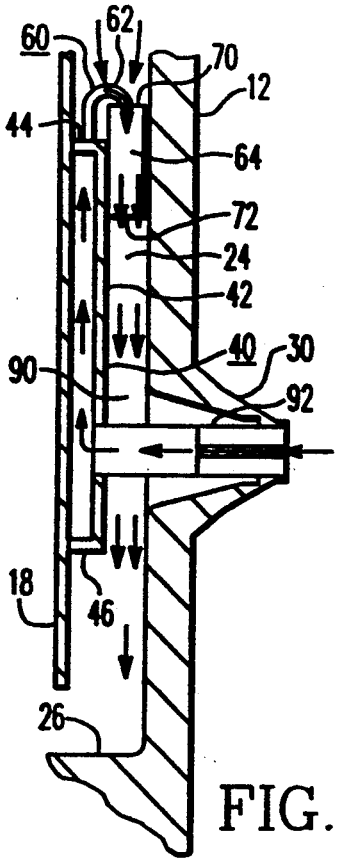
FIG. 2 is a sectional view of a distribution means attached to a wrapper of the steam generator.
Figure 3:
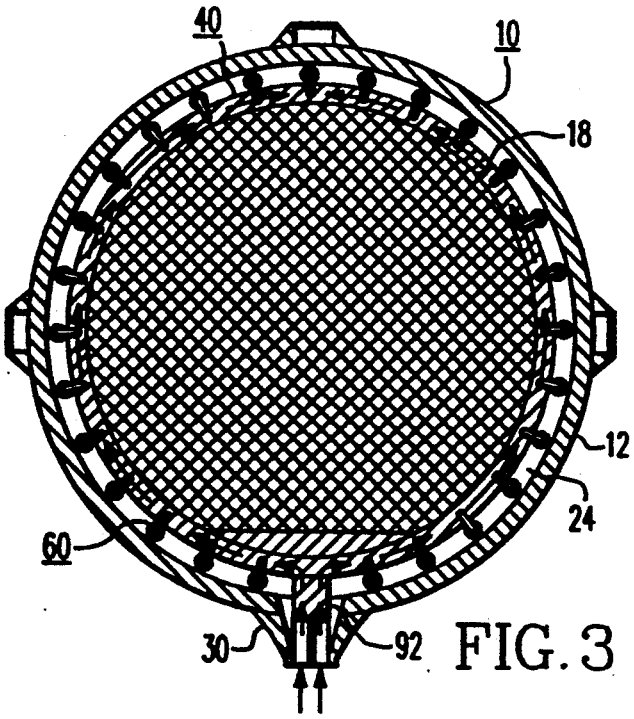
FIG. 3 is a cross-sectional view of the steam generator having the distribution means of FIG. 2 encircling the tube bundle 360 degrees.

Referring to FIGS. 2 and 3, a distribution means, such as a distribution device 40, is positioned between the wrapper 18 and the shell 12 within the annular downcomer region 24 of the steam generator 10. The distribution device 40 comprises a plurality of walls which form an enclosure for uniformly distributing the feedwater in the downcomer region 24. The distribution device 40 may comprise first side wall 42, a second wall 44 positioned at an upper end of the distribution device 40 and having a plurality of apertures therethrough, and a third wall 46 positioned at a lower end of the distribution device 40. The upper end of the distribution device 40 is defined as that end of the distribution device 40 near the upper portion 14 of the steam generator 10 and the lower end of the distribution device 40 is defined as that end of the distribution device 40 near the tubesheet 26. The distribution device 40 is attached to the wrapper 18, which constitutes a side wall of the distribution device 40.

Figure 5:
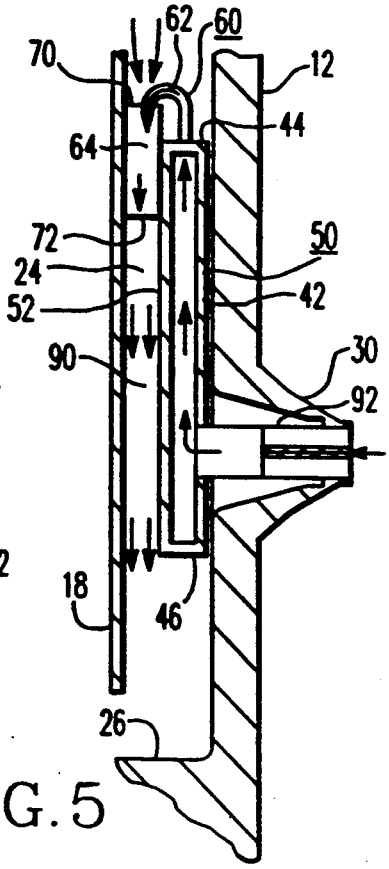
FIG. 5 is a sectional view of a alternative embodiment of the distribution means of FIG. 2.

Referring to FIG. 5 and using the same reference characters to define like parts, an alternative embodiment of the distribution device 40 as illustrated in FIGS. 2 and 3 may be a distribution device 50 having like parts as the distribution device 40 and additionally having a fourth side wall 52 positioned in a manner so that the first side wall 42, the second wall 44, the third wall 46, and the fourth side wall 52 form an enclosure for uniformly distributing the feedwater. The distribution device 50 is supported within the annular downcomer region 24 by a plurality of braces (not shown) that attach the first side wall 42 of the distribution device 50 to the shell 12 and by the inlet nozzle 30. The positioning of the distribution device 50 is such that recirculating water flows between the first side wall 42 and the shell 12 and between the fourth side wall 52 and the wrapper 18. The flow of recirculating water between the first side wall 42 and the shell 12 prevents the cold feedwater from contacting the shell 12, thereby limiting thermal shock to this pressure boundary.

Referring to FIGS. 2 and 5, the distribution means further comprises a downwardly directing means for directing the flow of the feedwater away from the shell 12 for reducing or preventing thermal shock to the shell 12. The downwardly directing means also directs the flow of the feedwater in the descending direction of the flow of the recirculating water so that the feedwater and recirculating water flow in the same direction for minimizing flow resistance.

Referring again to FIGS. 2 and 5, the downwardly directing means is a J-tube assembly, referred to generally as 60. The J-tube assembly 60 may be attached to the second wall 44 of the distribution devices 40 and 50 or may be attached to an upper end of the distribution devices 40 and 50. The J-tube assembly 60 comprises a plurality of J-shaped tubes 62 positioned circumferentially along the second wall 44 of the distribution devices 40 and 50 in alignment with the plurality of apertures in the second wall 44. The feedwater in the distribution devices 40 and 50 may flow through the apertures of the distribution devices 40 and 50 into the J-shaped tubes 62 and directly into the downwardly descending recirculating water in the annular downcomer region 24 of the steam generator 10.

Alternatively, the feedwater in the distribution devices 40 and 50 may flow through the J-shaped tubes 62 into a mixing tube 64 attached to each J-shaped tube 62. The mixing tube 64 has a first open end 70 and a second open end 72. The first open end 70 is attached to an end of the J-shaped tube 62 for receiving the feedwater flowing through the J-shaped tube 62. The recirculating water descending in the downcomer region 24 is drawn through the first open end 70 of the mixing tube 64 due to a low pressure zone at the first open end 70 caused by the jet of feedwater exiting the J-tube at the second open end 72 of the J-shaped tube 62.

The configuration and dimensions of the mixing tube 64 are a function of the flow rate and the temperatures of the feedwater and the recirculating water for enabling the feedwater and the recirculating water to substantially uniformly mix prior to the discharge of the mixture from the mixing tube 64 into the downcomer region 24. Also, to provide uniform mixing of the feedwater and the recirculating water prior to the feedwater contacting the tubesheet 26 or entering the tube bundle 20, the distance from the discharge of the feedwater from the J-shaped tube 62 to the tubesheet 26 is a function of the flow rate and the temperatures of the feedwater and the recirculating water. By uniformly mixing the colder feedwater with the warmer recirculating water, a mixture with a temperature warmer than the temperature of the feedwater can be introduced into the tube bundle 20, thereby reducing the possibility of water hammer and thermal shock to the steam generators 10 and 32.

Figure 6:
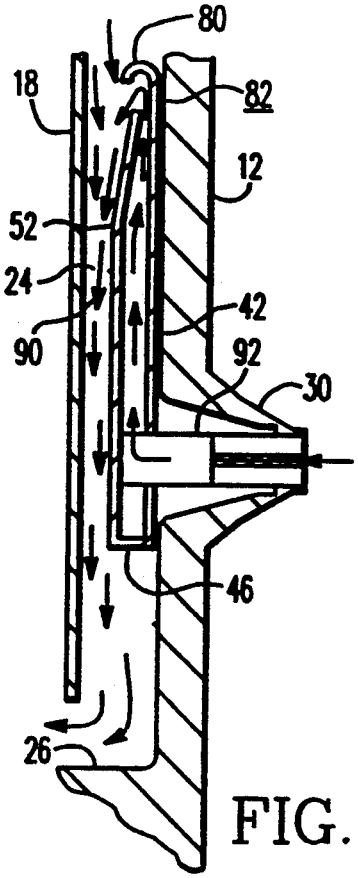
FIG. 6 is a sectional view of an another alternative embodiment of the distribution means of FIG. 2 having a weir as the downwardly directing means.
Figure 9:
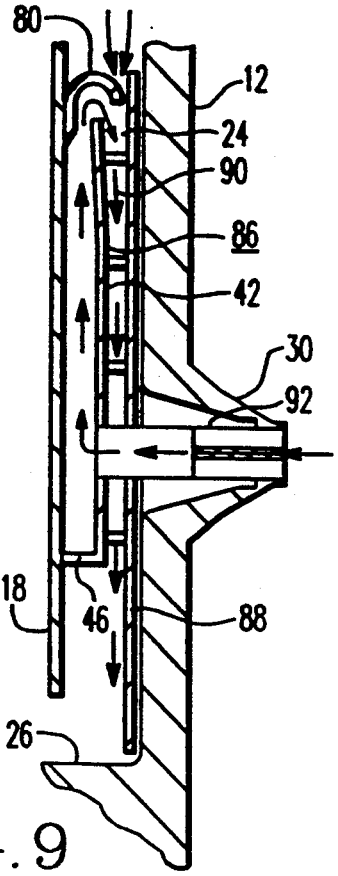
FIG. 9 is a sectional view of still another alternative embodiment of the distribution means of FIG. 2 having a weir as the downwardly directing means.

Referring to FIGS. 6 and 9, an alternative embodiment of the downwardly directing means is a weir 80. The weir 80 is a wall portion deformed into a U-like shape. The weir 80 directs the flow of the feedwater away from the shell 12 for preventing thermal shock to this pressure boundary and directs the flow of the feedwater in the descending direction of the flow of the recirculating water so that the feedwater and the recirculating water flow in the same direction for minimizing flow resistance.

Referring to FIG. 6 and using the same reference characters to define like parts, an alternative embodiment of the distribution device 50 of FIG. 5 may be a distribution device 82 having the weir 80 as the downwardly directing means. The weir 80 may be the second wall 44 which is attached to the first side wall 42 of the distribution device 82 or may be integrally formed with the first side wall 42. A portion of the fourth side wall 52 of the distribution device 82 is deformed at an angle toward the first side wall 42 for enabling the feedwater to discharge through an opening formed by an end of the weir 80 and an end of the fourth side wall 52 in a descending direction. Alternatively, if the weir 80 extends beyond the end of the fourth side wall 52 (not shown), then a portion of the fourth side wall 52 need not be deformed at an angle.

Referring to FIG. 9 and using the same reference characters to define like parts, an alternative embodiment of the distribution device 40 of FIG. 2 may be a distribution device 86 having the weir 80 as the downwardly directing means. The weir 80 may be attached to the wrapper 18 in a manner so that the feedwater flowing upwardly through the distribution device 86 exits in the opening between an end of the weir 80 and an end of the first side wall 42 of the distribution device 86. A portion of the first side wall 42 of the distribution device 86 is deformed at an angle toward the wrapper 18 for enabling the feedwater to discharge through the opening formed by the weir 80 and the first side wall 42 in a descending direction. Additionally, a thermal shield 88 is attached to the first side wall 42 for preventing the flow of the feedwater and the recirculating water from contacting the shell 12 for limiting the thermal shock to this pressure boundary.

The configuration and dimensions of the distribution devices 40, 50, 82 and 86, including the distance from the discharge of the feedwater from the downwarding directing means to the tubesheet 26, are a function of the flow rate and the temperatures of the feedwater and the recirculating water for enabling the feedwater and the recirculating water to substantially uniformly mix prior to the discharge of the mixture from the downcomer region 24 into the tube bundle 20. Preferably, the feedwater and recirculating water will uniformly mix in the mixing zone 90, which is located between the opposite ends of the distribution devices 40, 50, 82 and 86. By uniformly mixing the cold feedwater with the warmer recirculating water, a mixture with a temperature warmer than the temperature of the feedwater can be introduced into the tube bundle 20, thereby reducing the possibility of water hammer and thermal shock to the steam generators 10 and 32.

Referring to FIGS. 3, 4, 7, and 8, the distribution devices 40, 50, 82 and 86 may extend arcuately around at least a portion of the annular downcomer region 24. FIG. 4 illustrates the embodiment of the distribution device 40 of FIG. 2 and FIG. 8 illustrates the embodiment of the distribution device 82 of FIG. 6 utilized in the cold leg side 36 of a steam generator 32 having a preheater (not shown) for substantially uniformly mixing the feedwater and the recirculating water in the cold leg side 36 of the steam generator 32 prior to the mixture exiting the cold leg side 36. Preferably, the distribution devices 40 and 82 extend less than 180 degrees circumferentially around the wrapper 18 in the annular downcomer region 24 for substantially uniformly distributing the feedwater throughout a portion of the steam generator 32 constituting the cold leg side 36 of the steam generator 32.

Figure 7:
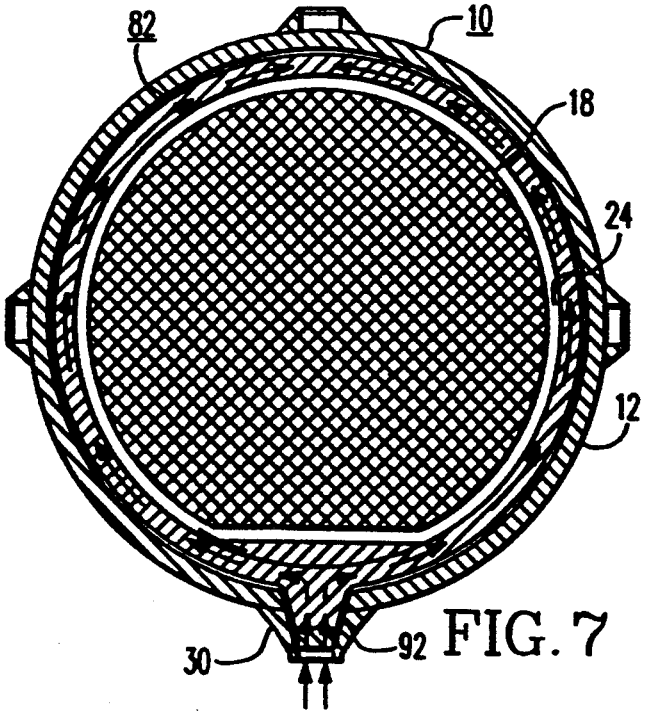
FIG. 7 is a cross-sectional view of the steam generator having the distribution means of FIG. 5 encircling the tube bundle 360 degrees.

FIG. 3 illustrates the embodiment of the distribution device 40 of FIG. 2 and FIG. 7 illustrates the distribution device 82 of FIG. 6 extending arcuately 360 degrees around the wrapper 18 in the annular downcomer region 24 of the steam generator 10. Feedwater flows through inlet nozzle 30 and arcuately in both directions around the entire circumference of the wrapper 18 of steam generator 10.

The inlet nozzle 30 comprises a liner 92 for separating the feedwater flowing through the inlet nozzle 30 from the shell 12 for preventing thermal shock to the shell 12. The distribution devices 40, 50, 82 and 86 are attached to the liner 92 of the inlet nozzle 30. Feed-water enters the distribution devices 40, 50, 82, and 86 through the inlet nozzle 30 and through an opening positioned near the lower end of the first side wall 42 of the distribution devices 40, 50, 82 and 86.

Referring to FIG. 1, the inlet nozzle 30 is positioned near the tubesheet 26 located in a lower portion 16 of the steam generators 10 and 32. The inlet nozzle 30 may be positioned at any elevation between the opposite ends of the downcomer region 24 of the steam generators 10 and 32 for discharging the feedwater into the distribution devices 40, 50, 82 and 86.

The circulation ratio is calculated by dividing the total flow of the feedwater and the recirculating water by the flow of the feedwater. As a result of the action of the distribution means, to obtain a circulation ration of 3:1, each part feedwater mixes with two parts recirculating water. Therefore, if the feedwater entering the inlet nozzle 30 has a temperature of 435° F. and the saturated water (or recirculating water descending in the downcomer region) has a temperature of 540° F., then the mixture of one part feedwater with two parts recirculating water has a temperature of 505° F., which is above the temperature which could cause water hammer conditions and thermal shock to the steam generator.

The distribution means automatically controls the temperature of the feedwater introduced into the tube bundle 20 as the plant outputs vary. At lower plant outputs, the temperature of the feedwater and the flow rate of the feedwater entering the steam generator are reduced. Because the decreased flow rate of the feedwater allows an increased proportion, of recirculating water into the mixing zone 90 between the opposite ends of the distribution means, the increased ratio of the recirculating water to the feedwater compensates for the lower temperature of the feedwater, thereby automatically controlling the temperature of the mixture of feedwater and recirculating water entering the tube bundle.

At higher plant outputs, the temperature of the feedwater and the flow rate of the feedwater entering the steam generator are increased. The increased flow rate of the feedwater restricts the flow of the recirculating water in the mixing zone 90 of the downcomer region, which increases the ratio of the feedwater to the recirculating water in the downcomer region. Because of the higher temperature of the feedwater entering the steam generator, a decreased ratio of the recirculating water to feedwater in the mixing zone 90 will maintain the temperature of the mixture of feedwater and recirculating water reasonably close to the saturation temperature of the tube bundle 20 to prevent water hammer and thermal shock.

OPERATION

Referring again to FIGS. 2–5, feedwater enters the steam generators 10 and 32 through the inlet nozzle 30. The feedwater passes through the inlet nozzle 30 into the distribution means, such as distribution devices 40 and 50. The feedwater is evenly distributed around the lower portion of the distribution means. As illustrated in FIG. 3, the feedwater is evenly distributed 360 degrees around the wrapper 18 of the steam generator 10. As illustrated in FIG. 4, the feedwater is evenly distributed around the wrapper 18 in the cold leg side 36 of the steam generator 32.

Still referring to FIGS. 2–5, after the feedwater is evenly distributed around the circumference of the distribution means, the feedwater ascends evenly in the distribution means. The feedwater is uniformly discharged from the distribution means through a downwardly directing means, such as a J-tube assembly 60 having a plurality of J-shaped tubes 62, into the annular downcomer region 24 of the steam generators 10 and 32. The plurality of J-shaped tubes 62 direct the feedwater into a descending direction. The descending feedwater mixes with descending recirculating water in the mixing zone 90 in the downcomer region 24 of the steam generators 10 and 32. Also, the downwardly directing means directs the flow of feedwater away from the shell 12 preventing contact of the colder feedwater with the warmer shell 12, thereby preventing thermal shock to this pressure boundary. The mixture of feedwater and recirculating water enters the tube bundle 20.

Referring to FIGS. 2–5, in addition to the interaction of the parts as described above, the J-shaped tube 62 may direct the feedwater into a descending direction into the mixing tube 64. The low pressure zone at the first open end 70 of the mixing tube 64 draws the recirculating water into the mixing tube 64. The feed-water and recirculating water are substantially uniformly mixed in the mixing tube 64 and in the mixing zone 90 of the downcomer region 24 of the steam generators 10 and 32, prior to contacting the tubesheet 26 or entering the tube bundle 20.

Referring to FIGS. 6–9, in addition to functioning similarly to the embodiments illustrated in FIGS. 2–5, after the feedwater evenly distributes in the distribution means, the feedwater is discharged from the distribution means in a descending direction by the weir 80. The feedwater mixes with the descending recirculating water in the mixing zone 90 of the downcomer region 24.

Referring to FIGS. 5 and 6, the recirculating water also descends between the shell 12 and the first side wall 42 of the distribution means for insulating the warmer shell 12 from the colder feedwater flowing in the distribution means.

Therefore, the feedwater distribution system provides for substantial uniform mixing of the recirculating water and feedwater at any elevation within the downcomer region of the steam generator.

We claim:

1. A steam generator, comprising:

a shell portion;

a plurality of tubes forming a tube bundle and disposed within said shell portion;

a tubesheet having a plurality of apertures therethrough for receiving an end of said tubes;

a wrapper encircling said tube bundle and forming an annular downcomer region between said wrapper and said shell;

moisture separating means positioned above said tube bundle for separating a steam-water mixture into recirculating water, which descends within said annular downcomer region, and steam;

an inlet nozzle attached to said shell for permitting the flow of feedwater into said steam generator;

distribution means, positioned between said shell and said wrapper in said downcomer region and attached to said inlet nozzle, for receiving said feedwater from said inlet nozzle and for distributing said feedwater substantially uniformly throughout at least a portion of said annular downcomer region; and means for directing said feedwater discharging from said distribution means in a descending direction for substantially uniformly mixing said feedwater and said recirculating water within said annular downcomer region prior to said feedwater and said recirculating water exiting said downcomer region, for limiting thermal shock and water hammer in said steam generator.

2. The steam generator according to claim 1, wherein said inlet nozzle is positioned near said tubesheet located in a lower portion of said steam generator for introducing said feedwater into said annular downcomer region of said lower portion of said steam generator, a distance from the steam region of said steam generator located at an upper portion of said steam generator for preventing steam collapse.

3. The steam generator according to claim 1, wherein said distribution means comprises a distribution device extending arcuately in said downcomer region for directing said feedwater substantially uniformly around at least a portion of said annular downcomer region for substantially uniformly discharging said feedwater into said recirculating water flowing in said downcomer region.

4. The steam generator according to claim 3, wherein the configuration of said distribution device and of said downcomer region provides automatic temperature control of the mixture of said feedwater and said recirculating water as plant outputs vary for limiting thermal shock and water hammer to said steam generator.

5. The steam generator according to claim 3, wherein said steam generator further comprises a cold leg side having a preheater and a hot leg side.

6. The steam generator according to claim 5, wherein said distribution device extends less than 180 degrees circumferentially around said wrapper for substantially uniformly distributing said feedwater throughout a portion of said steam generator constituting said cold leg side of said steam generator.

7. The steam generator according to claim 3, wherein said distribution device extends 360 degrees circumferentially around said wrapper for distributing said feedwater substantially uniformly around said circumference of said wrapper of said steam generator.

8. The steam generator according to claim 3, wherein said distribution device has at least one wall which is attached to said wrapper in a manner so that said wall and said wrapper form an enclosure and so that said recirculating water flows between one of said walls and said shell in said downcomer region for separating said feedwater from said shell for limiting thermal shock to said shell.

9. The steam generator according to claim 3, wherein said distribution device has at least one wall positioned in a manner so that said wall forms an enclosure and so that said recirculating water flows between one of said walls and said shell for separating said feedwater from said shell for limiting thermal shock to said shell.

10. The steam generator according to claim 1, wherein said means for directing said feedwater is a weir for directing the flow of said feedwater away from said shell for preventing said feedwater from contacting said shell for reducing thermal shock to said shell and for directing the flow of said feedwater in the descending direction of flow of said recirculating water for minimizing flow resistance.

11. The steam generator according to claim 1, wherein said means for directing said feedwater comprises a plurality of J-tube assemblies positioned circumferentially around said distribution means for discharging said feedwater from said distribution means.

12. The steam generator according to claim 11, wherein said J-tube assembly comprises a J-shaped tube attached to an upper end of said distribution means for discharging said feedwater in a descending direction into said recirculating water in said downcomer region.

13. The steam generator according to claim 12, wherein said J-tube assembly further comprises a mixing tube having a first open end and a second open end, said first open end attached to an end of said J-shaped tube for receiving said feedwater flowing through said J-shaped tube and for receiving said recirculating water flowing through said downcomer region, for substantially uniformly mixing said feedwater and said recirculating water within said mixing tube prior to discharge of a mixture of said feedwater and said recirculating water from said second open end of said mixing tube for preventing said feedwater from causing thermal shock to said steam generator.

14. The steam generator according to claim 13, wherein said mixing tube has a low pressure zone at said first open end caused by a jet of said feedwater exiting said J-shaped tube for drawing said recirculating water into said first open end of said mixing tube.

15. A steam generator, comprising:

a shell portion;

a plurality of tubes forming a tube bundle and disposed within said shell portion;

a tubesheet having a plurality of apertures therethrough for receiving an end of said tubes;

a wrapper encircling said tube bundle and forming an annular downcomer region between said wrapper and said shell;

moisture separating means positioned above said tube bundle for separating a steam-water mixture into recirculating water, which descends within said annular downcomer region, and steam;

an inlet nozzle attached to said shell at a lower portion of said shell near said tubesheet for permitting the flow of feedwater into said steam generator;

a distribution device, positioned between said shell and said wrapper in said downcomer region, attached to said inlet nozzle, and extending circumferentially within at least a portion of said downcomer region for receiving said feedwater from said inlet nozzle and for distributing said feedwater substantially uniformly arcuately and in an ascending direction within said distribution device; and means for directing said feedwater discharging from said distribution device into said annular downcomer region in a descending direction for mixing said feedwater and descending recirculating water substantially uniformly within said downcomer region prior to said feedwater and said recirculating water exiting said downcomer region, for limiting thermal shock and water hammer to said steam generator.

16. The steam generator according to claim 15, wherein said distribution device has at least one wall which is attached to said wrapper so that said recirculating flows between said wall and said shell in said downcomer region for separating said feedwater from said shell for limiting thermal shock to said shell.

17. The steam generator according to claim 15, wherein said distribution device has at least one wall positioned so that said recirculating water flows between one of said walls and said shell in said downcomer region for separating said feedwater from said shell for limiting thermal shock to said shell.

18. The steam generator according to claim 15, wherein said means for directing said feedwater is a weir for directing the flow of said feedwater away from said shell for preventing said feedwater from contacting said shell for reducing thermal shock to said shell and for directing the flow of said feedwater in the descending direction of flow of said recirculating water for minimizing flow resistance.

19. The steam generator according to claim 15, wherein said means for directing said feedwater comprises a plurality of J-tube assemblies positioned along an upper portion of said distribution means for discharging said feedwater substantially uniformly from said distribution means.

20. The steam generator according to claim 19, wherein said J-tube assembly comprises a J-shaped tube attached to an upper end of said distribution .means for discharging said feedwater, flowing in an ascending direction through said distribution means, in a descending direction into the descending flow of said recirculating water in said downcomer region for minimizing flow resistance.

21. The steam generator according to claim 20, wherein said J-tube assembly further comprises a mixing tube having a first open end and a second open end, said first open end attached to an end of said J-shaped tube for receiving said feedwater flowing through said J-shaped tube and for receiving said recirculating water flowing through said downcomer region, for substantially uniformly mixing said feedwater and said recirculating water within said mixing tube prior to discharge of a mixture of said feedwater and said recirculating water from said second open end of said mixing tube for preventing said feedwater from causing thermal shock to said steam generator.

22. A method for substantially uniformly mixing feedwater with recirculating water in a steam generator, having a shell, a wrapper, an annular downcomer region positioned between said shell and said wrapper, an inlet nozzle, a tube bundle positioned within said wrapper and a distribution device, comprising the steps of:

directing the flow of said feedwater from said inlet nozzle into said distribution device and circumferentially in both directions around at least a portion of aid annular downcomer region;

directing the flow of said feedwater uniformly distributed around said wrapper in an ascending direction in said distribution device toward a downwardly directing means of said distribution device;

discharging said feedwater from said downwardly directing means into said downcomer region; and mixing said feedwater exiting said downwardly directing means with descending recirculating water in said downcomer region of said steam generator prior to entry of said feedwater into said tube bundle for providing a substantially uniform mixture of said feedwater and said recirculating water for reducing thermal shock and water hammer to said steam generator.

23. The method according to claim 22, further comprising the steps of:

drawing said recirculating water descending in said downcomer region into a mixing tube of said downwardly directing means due to a low pressure zone at an end of said mixing tube caused by a jet pump effect of said feedwater exiting said downwardly directing means; and mixing said feedwater and said recirculating water in said mixing tube prior to the substantially uniform mixture of said feedwater and said recirculating water exiting said mixing tube into said downcomer region for reducing thermal shock to said steam generator.

24. The method according to claim 23, further comprising the step of controlling the temperature of said mixture of said feedwater and said recirculating water during various plant outputs of said steam generator by mixing a proportional amount of said feedwater with a proportional amount of said recirculating water for compensating for variations in temperature and flow rate of said feedwater flowing through said inlet nozzle.

25. The method according to claim 22, further comprising the step of controlling the temperature of said mixture of said feedwater and said recirculating water during various plant outputs of said steam generator by mixing a proportional amount of said feedwater with a proportional amount of said recirculating water for compensating for variations in temperature and flow rate of said feedwater flowing through said inlet nozzle.

26. The steam generator according to claim 1, wherein said means for directing said feedwater is a curved member attached to the distribution means for directing the flow of said feedwater in a descending direction for reducing thermal shock to said shell.

* * * * *